US011844425B2

(12) United States Patent
Thenin et al.

(10) Patent No.: US 11,844,425 B2
(45) Date of Patent: Dec. 19, 2023

(54) APPLICATOR FOR APPLYING A COSMETIC PRODUCT

(71) Applicant: L'Oreal, Paris (FR)

(72) Inventors: Audrey Thenin, Clichy (FR); Alain Berhault, Clichy (FR)

(73) Assignee: L'OREAL, Paris (FR)

( * ) Notice: Subject to any disclaimer, the term of this patent is extended or adjusted under 35 U.S.C. 154(b) by 608 days.

(21) Appl. No.: 16/641,868

(22) PCT Filed: Sep. 17, 2018

(86) PCT No.: PCT/EP2018/074992
§ 371 (c)(1),
(2) Date: Feb. 25, 2020

(87) PCT Pub. No.: WO2019/072493
PCT Pub. Date: Apr. 18, 2019

(65) Prior Publication Data

US 2020/0245751 A1 Aug. 6, 2020

(30) Foreign Application Priority Data

Oct. 10, 2017 (FR) ..... 1759472

(51) Int. Cl.
*A46B 9/02* (2006.01)
*A45D 40/26* (2006.01)
(Continued)

(52) U.S. Cl.
CPC ..... *A46B 9/021* (2013.01); *A45D 40/262* (2013.01); *A45D 40/267* (2013.01); *A46B 3/005* (2013.01);
(Continued)

(58) Field of Classification Search
CPC ..... A46B 9/021; A46B 3/005; A45D 40/262; A45D 40/267; A45D 1/0238
See application file for complete search history.

(56) References Cited

U.S. PATENT DOCUMENTS

2017/0000242 A1 1/2017 Jacob et al.
2017/0354239 A1* 12/2017 Manici ..... A46B 9/021
2020/0054120 A1* 2/2020 Berhault ..... A46B 9/021

FOREIGN PATENT DOCUMENTS

EP 1607020 A1 12/2005
EP 1752066 A1 2/2007
(Continued)

OTHER PUBLICATIONS

International Search Report (ISR) for PCT/EP2018/074992 dated Oct. 8, 2018 (4 pages).
(Continued)

*Primary Examiner* — Shay Karls
(74) *Attorney, Agent, or Firm* — Shumaker, Loop & Kendrick, LLP

(57) ABSTRACT

The present invention relates to an applicator for applying a cosmetic, makeup or care, product to the eyelashes and/or eyebrows, having an applicator member including a core that extends along a longitudinal axis (X), and, carried by the core, longitudinal rows of islets of spikes that are separated by areas free of spikes, wherein, in said applicator, the islets of spikes include a series of spikes in the longitudinal direction and a series of spikes in the circumferential direction.

25 Claims, 2 Drawing Sheets

Figure 1:
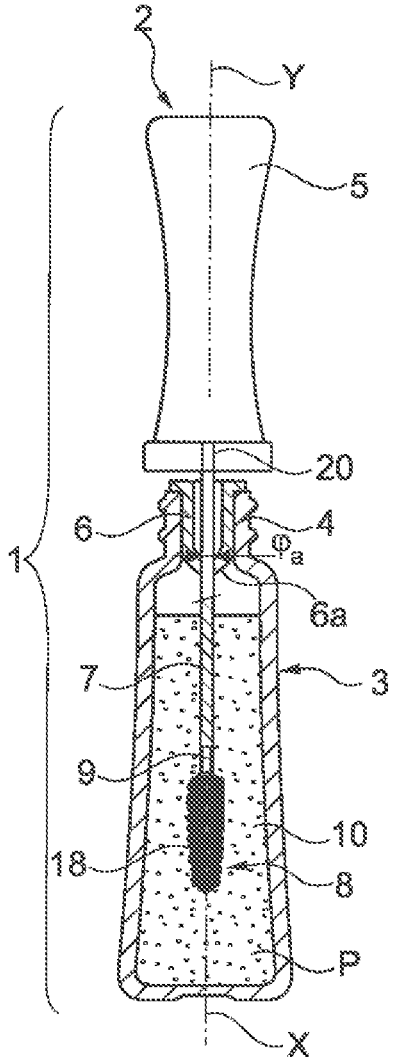

(51) Int. Cl.
*A46B 3/00* (2006.01)
*A46D 1/00* (2006.01)

(52) U.S. Cl.
CPC .... *A46D 1/0238* (2013.01); *A46B 2200/1053* (2013.01)

(56) References Cited

FOREIGN PATENT DOCUMENTS

| | | | | |
|---|---|---|---|---|
| EP | 2164360 | B1 | 9/2012 | |
| FR | 2831032 | A1 | 4/2003 | |
| FR | 2903585 | A1 | 1/2008 | |
| FR | 2909532 | A1 | 6/2008 | |
| FR | 3030203 | A1 | 6/2016 | |
| KR | 2010-0073557 | A | 7/2010 | |
| WO | 2014174423 | A1 | 10/2014 | |
| WO | WO-2016102659 | A1 * | 6/2016 | ..... A45D 40/262 |
| WO | 2017003506 | A1 | 1/2017 | |

OTHER PUBLICATIONS

Written Opinion of the International Search Authority for PCT/EP2018/074992 dated Oct. 8, 2018 (5 pages).

* cited by examiner

APPLICATOR FOR APPLYING A COSMETIC PRODUCT

TECHNICAL FIELD

The present invention relates to an applicator for applying a cosmetic, makeup or care, product to the eyelashes and/or eyebrows, for example mascara. The invention also relates to devices comprising the applicator and to a container containing the product to be applied.

PRIOR ART

The container is conventionally provided with a wiping member which wipes the stem of the applicator as it is withdrawn from the container. The behaviour of the applicator member as it passes through the wiping member depends on numerous factors, such as the shape and nature of the lip of the wiping member and the arrangement of the application elements on the applicator member.

A compromise has to be found with regard to the quantity of product which is left on the applicator member for application of makeup. Excessive wiping of the applicator member causes the latter to be insufficiently loaded and obliges the user to frequently dip the applicator back into the container. Insufficient wiping leaves an excess of product that is difficult to manage and could result in clumps of product on poorly separated eyelashes.

The application FR 2 909 532 describes a brush having a flat and perforated support structure carrying application elements on its two faces.

The application US 2017/000242 describes a brush having an alternation of longitudinal rows of application elements and longitudinal rows of teeth in the form of a rake.

The applications FR 3 030 203 and KR 2010-0073557 disclose brushes having groups of several application elements disposed in line along the longitudinal axis of the brush, these groups of elements being arranged along longitudinal rows that are offset axially such that the groups of elements in the offset row occupy the same axial position as the free element spaces between two groups of elements in the adjacent row.

The application WO 2014/174423 discloses an applicator, the core of which carries spikes and has a plurality of grooves oriented perpendicularly or obliquely with respect to the longitudinal axis of the core. These grooves that do not have spikes contribute towards the flexibility of the brush, and loading in bunches, the eyelashes being stuck together regularly.

The patent EP 2 164 360 discloses a brush, the core of which has a helical furrow constituting a region for storing the product to be applied, the application elements being present outside and in the furrow.

Objective of the Invention

There is a need to further improve applicators for applying a product, notably mascara, to the eyelashes and/or eyebrows, in order to improve the performance thereof, and more particularly to promote the creation on the applicator member of regions that are more heavily laden with product, which allow easy application of makeup and rapid and abundant loading of the eyelashes and/or eyebrows, while retaining a satisfactory capacity for separating the latter.

SUMMARY OF THE INVENTION

The invention aims to meet this objective and the subject thereof, according to one of its aspects, is an applicator for applying a cosmetic, makeup or care, product to the eyelashes and/or eyebrows, having an applicator member comprising:

a core that extends along a longitudinal axis, and, carried by the core, longitudinal rows of islets of spikes that are separated by areas free of spikes, wherein, in said applicator, the islets of spikes comprise a series of spikes in the longitudinal direction and a series of spikes in the circumferential direction.

The islets of spikes within a row of islets are thus separated axially by a region that does not have spikes and serves as a reserve of product. The islets correspond to groups of spikes isolated from each other: by turning around the axis of the core and moving in the longitudinal direction, there are groups of spikes completely isolated from the other spikes.

The invention makes it possible to obtain, on the applicator member, notably in the areas free of spikes, at least one region that forms a reservoir, the contents of said region being emptied little while the applicator is being withdrawn, thus producing, after wiping, a surplus of product and channels of product along the entire length of the core and on all sides, in other words along and around the core. This surplus of product allows, from the first application, satisfactory loading of the eyelashes and/or eyebrows with product, these areas free of spikes allowing in particular a direct and rapid transfer of product onto the eyelashes and/or eyebrows.

Preferably, at least one longitudinal row of islets is offset axially with respect to the adjacent longitudinal row such that the centre of at least one islet of spikes in the offset row is situated halfway along the length of an area free of spikes between two islets of spikes in the adjacent row of islets. The length of an area free of spikes corresponds to the spacing between two consecutive islets of spikes, measured from the base of the core, between the outer flanks of the last spike of the first islet and the first spike of the second islet, along the axis of the longitudinal row containing the islets. The centre of an islet of spikes corresponds to the point situated halfway along the length of the islet. The "length of an islet of spikes" should be understood as meaning the distance between the outer flank of the first spike of the islet and the outer flank of the last spike, in the longitudinal direction, measured at the base of the core.

The applicator according to the invention makes it possible to separate the eyelashes and/or eyebrows, avoiding the formation of clumps, by virtue notably of the axial offset between the longitudinal rows of islets. On each pass of the applicator, the eyelashes and/or eyebrows come into contact with areas free of spikes that form a reservoir and with islets of spikes in order to be loaded with product while benefiting from good separation and good combing.

During manufacture, it is possible to vary the spacing between and arrangement of the spikes of the islets of spikes for the one part, the spacing between the islets of spikes for the other part, and the axial offset between the longitudinal rows of islets, in order to alter the extent to which the applicator is charged with product after wiping.

The "longitudinal axis of the core" denotes the line connecting all of the centres of mass of the cross sections of the core. The longitudinal axis may be a central axis, or even an axis of symmetry for the core, notably when the core has a circular cross section or a cross section in the overall shape of a regular polygon. The longitudinal axis of the core may be rectilinear or curved and may be contained in a plane, which may be a plane of symmetry for some or even for all of the cross sections of the core. Preferably, the longitudinal axis of the core is rectilinear.

The term "spike" denotes an individualizable projecting element intended to come into engagement with the eyelashes and/or eyebrows.

A "series of spikes in the circumferential direction" should be understood as meaning a series of spikes that occupy one and the same axial position on the longitudinal axis of the core.

The expression "axially offset longitudinal rows" should be understood as meaning that the islets of the same rank in these rows do not occupy the same position along the longitudinal axis of the core.

Core, Islets and Spikes

Each longitudinal row of islets of spikes is preferably offset axially with respect to the adjacent longitudinal row.

The centre of each islet of spikes in at least one row is situated preferably halfway along the length of an area free of spikes between two islets of spikes in the adjacent row; better still, the centre of each islet of spikes of the core is situated halfway along the length of an area free of spikes between two islets of spikes in the adjacent rows.

The islets of spikes of the same rank of one longitudinal row of islets out of two can all occupy the same axial position along the longitudinal axis of the core.

The islets of spikes can be spaced apart regularly along the longitudinal rows of islets.

The spacing between the consecutive islets of spikes is preferably constant within at least one longitudinal row of islets, better still within each longitudinal row. In one variant, the spacing between the consecutive islets of spikes is variable within at least one longitudinal row and/or from one row to another.

Within a longitudinal row of islets, the spacing between two consecutive islets of spikes, measured along the longitudinal axis of the core and at the base of the core, between the outer flanks of the last spike of a first islet and of the first spike of a second islet consecutive to the first islet, along the axis of the row containing the islets, can be between 1 mm and 3 mm, better still between 1.5 mm and 2.5 mm.

The spacing between the consecutive islets of spikes is preferably constant in the circumferential direction, for at least one axial position along the longitudinal axis of the core, better still for each axial position. In one variant, the spacing between the consecutive islets of spikes in the circumferential direction is variable for one and the same axial position along the longitudinal axis of the core and/or from one axial position to another.

In the circumferential direction, the spacing between two consecutive islets of spikes, measured perpendicularly to the longitudinal axis of the core and at the base of the core, between the outer flanks of the last spike of a first islet and of the first spike of a second islet consecutive to the first islet, can be between 0.3 mm and 2 mm, better still between 0.5 mm and 1 mm.

The areas free of spikes advantageously form at least one helical strip that does not have spikes, extends through more than half a revolution about the longitudinal axis of the core and is delimited by the islets of spikes. The areas free of spikes notably form at least two intersecting helical strips that do not have spikes and are delimited by the islets of spikes. This allows a uniform distribution over the core, in the longitudinal direction and in the circumferential direction, in other words along and around the core, of regions forming a reservoir of product. This configuration also affords an advantageous visual appearance, in a chequerboard pattern, when the brush is loaded with product. This also makes it possible to have homogeneous and especially regular offloading onto the eyelashes with significant eyelash separation without bunches. The invention thus allows a good balance between loading via the reserve of product, in the regions of the brush that do not have spikes, and separation of the eyelashes by virtue of the arrangement of the spikes. In any portion of the brush, the eyelash is advantageously combed in a repeatable manner via the intersecting helical strips.

In one or more areas free of spikes, better still in all the areas free of spikes, the core can have a surface that is concave towards its longitudinal axis, these regions being slightly recessed in the direction of the longitudinal axis, for example to a depth, measured perpendicularly to the longitudinal axis, of between 0.01 mm and 0.05 mm. In a variant or in combination, the core can have, in the areas free of spikes, a textured surface, notably having rectilinear or curved grooves, extending along the longitudinal axis of the core or along an axis perpendicular to this axis. The recessed areas free of spikes of the core and/or their textured surface make it possible to load the applicator with an increased amount of product.

In one preferred embodiment of the invention, at least one islet of spikes, better still all the islets of spikes, comprise(s) a number of spikes in the circumferential direction that increases in the longitudinal direction from the proximal end of the core, passing through a maximum, before decreasing in the direction of the distal end of the core, the maximum of the number of spikes being situated notably at the centre of the islet.

At least one islet of spikes, better still all the islets of spikes, can have, at successive axial positions in the longitudinal direction, an isolated spike, followed by a series of two spikes in the circumferential direction, and then a series of three spikes, and once again a series of two spikes and an isolated spike. All the spikes at the periphery of an islet preferably define a diamond-shaped external contour, formed by the external contours of the bases of the spikes. In a variant, the external contour formed by the external contours of the bases of the peripheral spikes of an islet has a circular or oval shape.

The implantation of the spikes within the islets of spikes may be such that the angular offset a about the longitudinal axis of the core between two successive spikes in the longitudinal direction is non-zero, preferably being equal to half the angular pitch $\beta$ between two successive spikes in the circumferential direction. The spikes are thus advantageously disposed in staggered rows within an islet of spikes. The spikes within an islet of spikes may be superposed when the applicator member is viewed from the proximal end of the core, along the longitudinal direction of the core, between one series of spikes in the longitudinal direction and the next series of spikes.

The longitudinal rows of islets may be offset axially such that, starting from the proximal end of the core in the direction of its distal end, the last spike of an islet of spikes in one longitudinal row of islets occupies the same axial position as the first spike of an islet in the adjacent row.

The longitudinal rows of islets may be offset axially such that, in the circumferential direction, the last spike of an islet of spikes in one longitudinal row of islets occupies the same longitudinal position as the first spike of an islet in the adjacent row.

The axial offset between one longitudinal row of islets of spikes and the adjacent longitudinal row may be less than or equal to the length of an islet of spikes in said adjacent row.

Preferably, the spikes within an islet of spikes are not superposed when the applicator member is viewed from the side in a direction perpendicular to the longitudinal axis of the core, between one axial position and the next axial position. The gaps thus formed between the spikes within an islet of spikes can receive the eyelashes and/or eyebrows, this favouring the combing and separation of the eyelashes and/or eyebrows during the application of the cosmetic product.

The spacing between the spikes of one islet, within the series of spikes in the longitudinal and circumferential directions, is preferably the same for all the islets. In one variant, the spacing between the spikes of an islet differs from one islet of spikes to another, within a series of spikes in the circumferential direction and/or in the longitudinal direction.

This spacing, measured along the longitudinal axis of a series of spikes of an islet in the circumferential direction, between the bases of the spikes that face one another, is preferably more than ten times less than the spacing between two consecutive islets of spikes within a longitudinal row of islets, and can be between 0 mm and 0.8 mm, better still between 0 mm and 0.3 mm.

It is possible for the spikes not to meet at their base. In one variant, the spikes of at least one islet meet at their base, the spacing between the bases of the spikes that face one another being zero.

All the islets of spikes advantageously have the same number of spikes. In one variant, the number of spikes differs from one islet of spikes to another, within one longitudinal row and/or from one longitudinal row to another.

The islets of spikes may have at least four spikes, for example nine spikes.

The number of islets of spikes per longitudinal row of spikes may be between three and ten.

At least one longitudinal row of islets may have an isolated spike at the distal end of the core, better still every other longitudinal row of islets has such a spike.

Within at least one and the same islet, the height of the spikes may vary. In one variant, the spikes of each islet are the same height.

Preferably, the height of the spikes varies, for example in a monotonous manner, along the longitudinal axis of the core. Within one longitudinal row of islets, the height of the spikes increases preferably from the proximal end of the core, passing through a maximum, before decreasing in the direction of the distal end of the core, the maximum height notably being situated halfway along the length of the core. In one variant, the height of the spikes is constant along the longitudinal axis of the core.

All of the spikes may be the same height in the circumferential direction, in each position on the longitudinal axis of the core.

The height of the spikes may be between 0.5 mm and 4 mm, better still between 2 mm and 3 mm. The "height of a spike" denotes the distance measured along the elongation axis of the spike between its free end and the base of the spike by way of which it is connected to the core. The "elongation axis of the spike" denotes an axis which passes through the centres of mass of the cross sections of the spike.

The spikes may have a width of between 0.2 mm and 0.85 mm, better still between 0.3 mm and 0.65 mm. The "width of a spike" denotes the greatest transverse dimension of the spike, in cross section, along the longitudinal axis of the core.

The spikes may have a thickness of between 0.2 mm and 0.85 mm, better still between 0.4 mm and 0.75 mm. The "thickness of a spike" denotes the greatest transverse dimension of the spike, in cross section, perpendicularly to the elongation axis of the spike and to the longitudinal axis of the core.

The spikes of at least one islet are advantageously the same shape, better still all the spikes of a longitudinal row are the same shape, and even better still all the spikes of the application member are the same shape. In one variant, the shape of the spikes differs within islets and/or from one islet to another.

The spikes may have any shape. The spikes advantageously have a cylindrical or tapered, in particular conical, frustoconical or pyramidal shape, notably with a hexagonal base. In one variant, the spikes have an asymmetric, semi-conical shape, having a first face with a first shape, notably a flat shape, and a second face with a second shape, for example a non-flat shape, notably a rounded shape.

The cross section of the spikes is advantageously polygonal, notably hexagonal. In one variant, the cross section of the spikes is substantially circular, elliptical or semi-elliptical, or may also be for example semi-circular (referred to as half-moon).

The spikes may each extend from the core along an elongation axis perpendicular to the surface of the core, at the point at which the spikes are attached to the core. In a variant, the elongation axis of the spikes forms an angle other than 90° with the surface of the core at the point at which the spikes are attached to the core.

The free ends of the spikes of the applicator member define an envelope surface of the applicator member, which is for example in the form of a cylinder of revolution along at least a part of its length.

The envelope surface may have a cross section that varies along all or part of the length of the applicator member. The cross section of the envelope surface may for example have one or more extremes, for example at least two local minima and one local maximum. The diameter of the cross section of the envelope surface passing through the tops of the spikes of smallest height may be between 4 mm and 9 mm. The diameter of the cross section of the envelope surface of the applicator member passing through the tops of the spikes of greatest height may be between 5 mm and 10 mm.

In one variant, the envelope surface has a greatest transverse dimension that is substantially constant along at least a part of the length of the applicator member, notably along more than half the part of the core that carries the spikes.

The spikes may be ended by a rounded, notably hemispherical, free end, the radius of which may be between 0.06 mm and 0.3 mm The longitudinal rows of islets are advantageously rectilinear, with preferably between four and twelve longitudinal rows of islets.

The core may have a cross section, measured perpendicularly to its longitudinal axis, of any shape, notably of circular shape. The greatest cross section of the core, namely its diameter in the case in which the cross section of the core has a circular shape, may be between 1.5 mm and 3.2 mm.

The core and the spikes may be moulded from one and the same material, or in a variant they can be made from at least two different materials. In exemplary embodiments of the invention, the spikes are produced by overmoulding on the core.

The core and/or the spikes are preferably produced from a thermoplastic material.

Applicator

The applicator may have a stem that carries the applicator member at a first end and is fixed to a gripping member at a second end.

The core may be solid, being for example moulded with an end piece for fixing to the stem of the applicator.

The applicator member may be fixed to the stem by snap-fastening, adhesive bonding, welding, crimping, pressing, stapling, force-fitting, fitting in a cold state or fitting in a hot state, for example by an end piece of the applicator member being mounted in a housing in the stem. In a variant, the stem is received in a housing provided in the core.

It is also possible for the stem and the applicator member to be moulded or not to be moulded in one piece and from the same thermoplastic material.

The spikes may be made of a material that is more or less rigid than a material used to produce the stem of the applicator to which the core is attached.

The core may extend along a longitudinal axis which, at at least one point along its length, forms a non-zero angle with the longitudinal axis of the stem to which the core is fixed. The applicator member may be angled at its attachment to the stem.

The stem may have a first, rigid portion that is extended on the distal side by a second, more flexible portion, for example made of elastomer, that carries the applicator member.

The visible length of the applicator member may be between 15 mm and 35 mm, better still between 22 mm and 29 mm.

The applicator may have a total of between 200 and 600 spikes, better still between 250 and 450 spikes.

Application Device

A further subject of the invention is a device for packaging and applying a product to the eyelashes and/or eyebrows, having an applicator according to the invention, as defined above, and a container containing the product to be applied.

The gripping member of the applicator may constitute a cap for closing the container.

The container may have a wiping member suitable for wiping the stem and the applicator member.

The product is preferably a mascara.

DETAILED DESCRIPTION

Figure 2A:
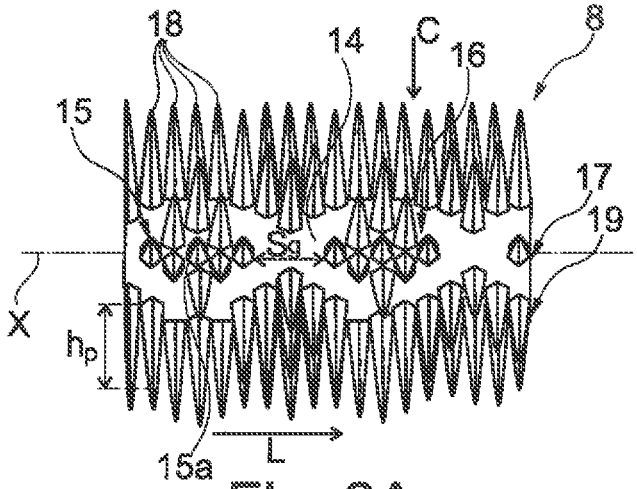
Figure 3:
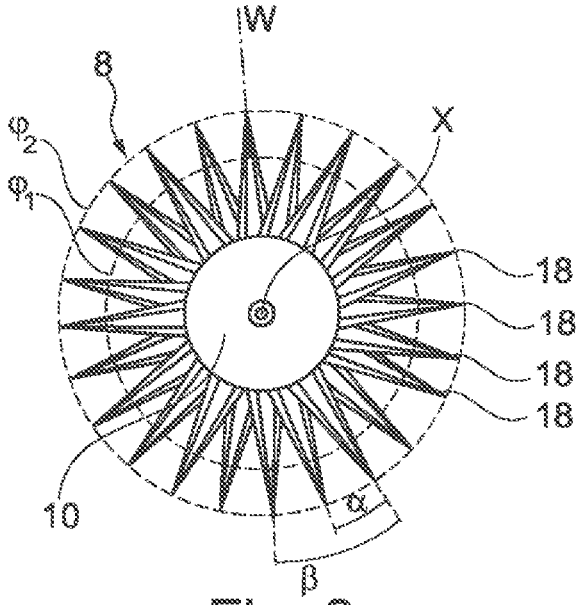
Figure 2:
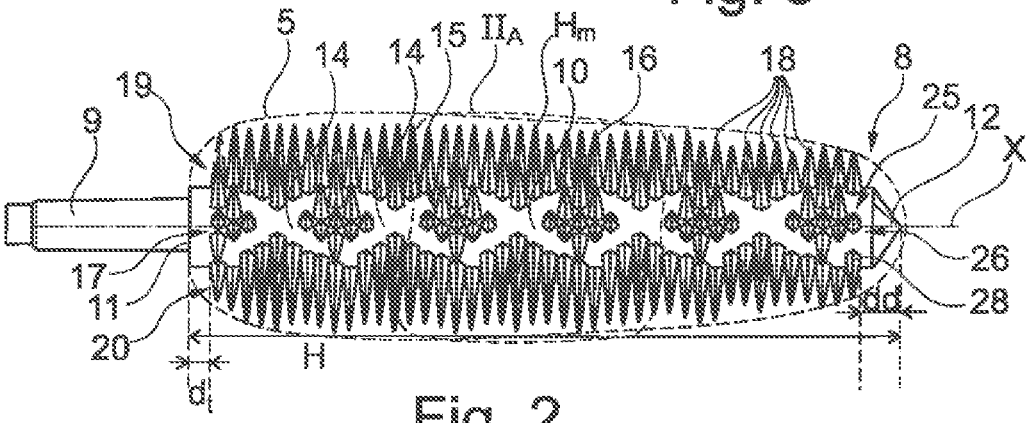
Figure 4:
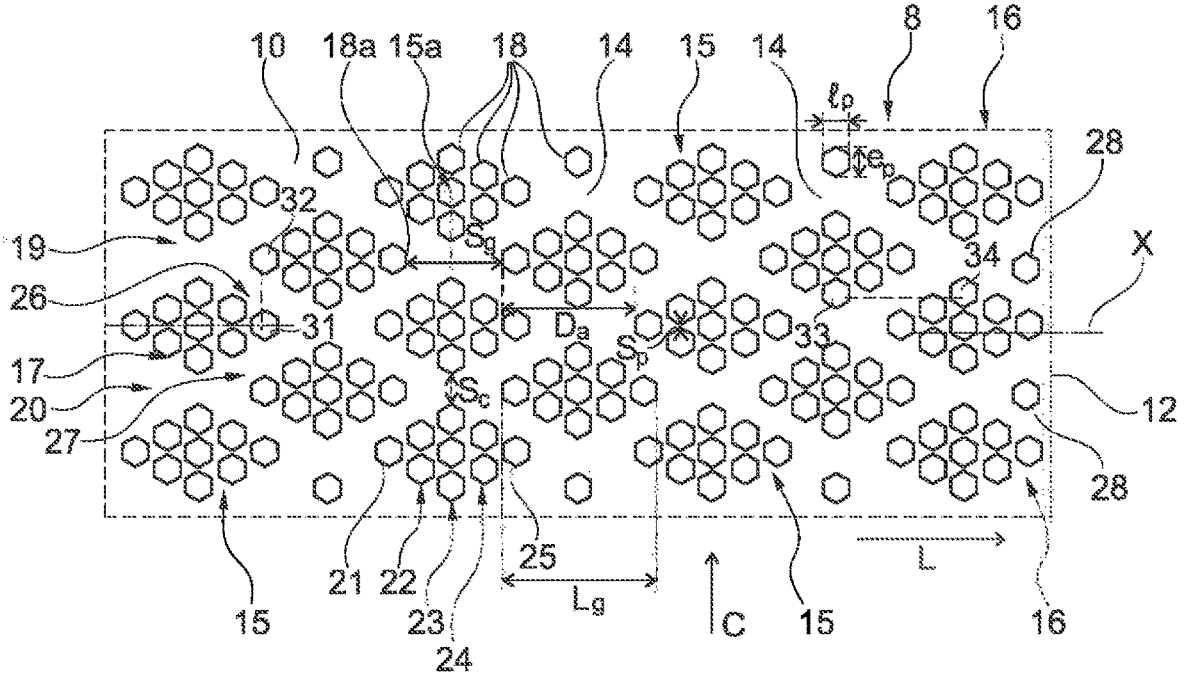
Figure 5:
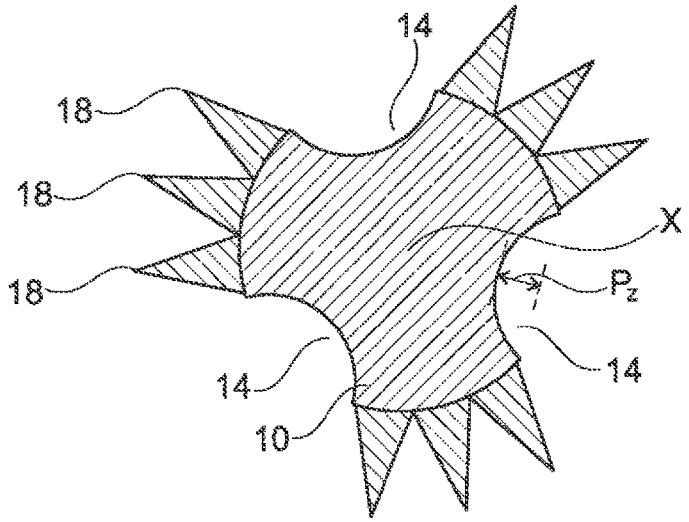

The invention may be understood better from reading the following detailed description of a non-limiting exemplary embodiment thereof, and with reference to the attached drawing, in which:

FIG. 1 is a schematic elevation view, in partial longitudinal section, of an example of a packaging and application device produced in accordance with the invention, FIG. 2 shows a perspective view of the applicator member from FIG. 1 on its own, FIG. 2A shows a detail of the applicator member from FIG. 2, FIG. 3 shows an end-on view of the applicator member from FIG. 1 on its own, FIG. 4 is a flat developed view illustrating the arrangement of some of the spikes on the surface of the core of an applicator member according to the invention, and FIG. 5 is a cross-sectional view of a variant applicator member according to the invention.

FIG. 1 shows a packaging and application device 1 produced in accordance with the invention, having an applicator 2 and an associated container 3 containing a product P to be applied to the eyelashes and/or eyebrows, for example mascara or a care product.

The container 3 has, in the example in question, a threaded neck 4 and the applicator 2 has a closure cap 5 designed to be fixed on the neck 4 so as to close the container 3 in a sealed manner when it is not in use, the closure cap 5 also constituting a gripping member for the applicator 2.

The latter has a stem 7 of longitudinal axis Y, which is attached at its upper end to the closure cap 5 and at its lower end to an applicator member 8. The latter has a core 10 carrying spikes 18 that extend from the core 10 and all around the latter. As can be seen in FIG. 2, the first spikes 18 along the longitudinal axis X of the core 10, starting from the stem 7, are arranged at a non-zero distance $d_t$ from the proximal end 11 of the core. The last spikes 18 along the longitudinal axis X of the core 10, starting from the stem 7, are arranged at a non-zero distance $d_d$ from the distal end 12 of the core 10.

The container 3 also has a wiping member 6, inserted into the neck 4.

This wiping member 6, which may be of any suitable type, has, in the example in question, a lip designed to wipe the stem 7 and the applicator member 8 when the applicator 2 is withdrawn from the container 3. The lip defines a wiping orifice 6*a* having a diameter $\varphi_a$ adapted to that of the stem 7. The wiping member 6 may be made of elastomer. The wiping orifice 6*a* has for example a circular shape.

The diameter $\varphi_a$ of the wiping orifice 6*a* is typically between 3 and 5.75 mm.

In the example illustrated, the stem 7 has a circular cross section, but it would not constitute a departure from the scope of the present invention if the stem 7 had a different cross section, it then being possible to fix the cap 5 on the container 3 in some other way than by screwing, if necessary. The wiping member 6 is adapted to the shape of the stem 7 and to that of the applicator member 8, if appropriate.

Preferably, and as in the example in question, the longitudinal axis Y of the stem 7 is rectilinear and coincident with the longitudinal axis of the container 3 when the applicator 2 is in place thereon, but it would not constitute a departure from the scope of the present invention if the stem 7 were not rectilinear, forming for example an elbow.

If need be, the stem 7 may have an annular narrowing at its portion that is positioned opposite the lip of the wiping member 6, so as not to mechanically stress the latter unduly during storage.

As illustrated in FIG. 2, the applicator member 8 may have an end piece 9 for fixing it in a corresponding housing in the stem 7.

The applicator member 8 may be fixed to the stem 7 by any means, and notably by force-fitting, snap-fastening, adhesive bonding, welding, stapling or crimping, in this housing.

With reference to FIG. 2, it can be seen that the core 10 has a shape that is elongate along a longitudinal axis X, which is rectilinear in the example described. The longitudinal axis X may be central, as illustrated.

The visible length H of the applicator member 8 is for example equal to 29 mm.

In the example illustrated, the spikes 18 each extend from the core 10 along an elongation axis W perpendicular to the surface of the core at the point at which the spike 18 is attached to the core 10.

In the example described, the spikes 18 are disposed in islets 15, 16 of spikes within rectilinear longitudinal rows 17, 19, 20 of islets, as can be seen notably in FIG. 2, each longitudinal row 17 of islets being offset axially with respect to the adjacent longitudinal rows 19, 20.

Preferably, as illustrated, the islets of spikes 15, 16 are regularly spaced along the longitudinal rows 17, 19, 20 and exhibit an alternation of islets 15, 16 of spikes and areas 14 free of spikes. In the example in question, the centre of each islet 15 of spikes 18 of the core 10 is situated halfway along the length $S_g$ of an area free of spikes 14 between two islets 15, 16 of spikes in adjacent rows.

The islets 15, 16 in every other longitudinal row of islets advantageously all occupy the same axial position along the longitudinal axis X of the core 10, as illustrated in FIG. 2, for example between the longitudinal rows 17 and 20.

As illustrated notably in FIGS. 2A and 4, the areas 14 free of spikes may form at least two intersecting helical strips 26, 27 that do not have spikes, extend through more than half a revolution about the longitudinal axis X of the core 10 and are delimited by the islets 15, 16 of spikes.

The longitudinal rows 17, 19 of islets are advantageously offset axially such that, starting from the proximal end 11 of the core 10 in the direction of its distal end 12, the last spike 31 of an islet of spikes in one longitudinal row 17 of islets occupies the same axial position as the first spike 32 of an islet in the adjacent row 19, as can be seen in FIG. 4. In this example, the longitudinal rows 17, 19 of islets are also offset axially such that, in the circumferential direction C, the last spike 33 of an islet of spikes in one longitudinal row 19 of islets occupies the same longitudinal position as the first spike 34 of an islet in the adjacent row 17.

Preferably, and as illustrated notably in FIGS. 2A and 4, all the islets 15, 16 of spikes 18 comprise a series of spikes 18 in the longitudinal direction L and a series of spikes 18 in the circumferential direction C. In the example in question, all the islets 15, 16 of spikes 18 comprise a number of spikes in the circumferential direction C that increases in the longitudinal direction L from the proximal end 11 of the core, passing through a maximum, before decreasing in the direction of the distal end 12 of the core 10, the maximum of the number of spikes being situated at the centre 15*a* of the islet.

More specifically, in the example in question, all the islets 15, 16 of spikes 18 have, at successive axial positions in the longitudinal direction L, an isolated spike 21, followed by a series 22 of two spikes in the circumferential direction C, and then a series 23 of three spikes in the circumferential direction C, and once again a series 24 of two spikes in the circumferential direction C and an isolated spike 25. All the spikes 18 at the periphery of an islet 15 thus define a diamond-shaped external contour. Other arrangements of spikes within the islets may be envisaged.

All the islets 15, 16 of spikes preferably have the same number of spikes 18. In a variant that is not illustrated, the number of spikes 18 differs from one islet 15 of spikes to another, within one longitudinal row 17, 19, 20 of islets and/or from one longitudinal row to another.

Preferably, and as in the example described, the spacing $S_p$ between the spikes 18 of one islet 15, 16, within the series of spikes in the longitudinal direction L and circumferential direction C, is the same for each islet, and is more than ten times less than the spacing $S_g$ between two consecutive islets 15, 16 of spikes 18 within a longitudinal row 17, 19 of islets. In a variant that is not illustrated, the spacing $S_p$ between the spikes 18 of an islet 15, 16 differs from one islet of spikes to another, within one longitudinal row 17, 19, 20 and/or from one longitudinal row to another. In another variant that is not illustrated, the spacing $S_p$ between the spikes 18 of an islet 15, 16, within the series of spikes, is different in the longitudinal direction L and in the circumferential direction C.

This spacing $S_p$ is for example between 0 mm and 0.3 mm.

In the example in question, the spacing $S_g$ between each consecutive islet 15, 16 of spikes is advantageously constant within each longitudinal row 17, 19, 20 of islets. In a variant that is not illustrated, the spacing $S_g$ is variable within at least one longitudinal row and/or from one row to another.

As shown in FIG. 4, the spacing $S_g$ between two consecutive islets 15, 16 of spikes, measured along the longitudinal axis X of the core and at the base of the core 10, between the outer flanks 18*a* of the last spike of a first islet 15 and the first spike of a second islet 16 consecutive to the first islet 15, along the axis of the row 19 containing the islets, is for example between 1.5 mm and 2.5 mm.

Preferably, and as shown, the spacing $S_c$ between consecutive islets 15, 16 of spikes 18 in the circumferential direction C is constant for each axial position along the longitudinal axis X of the core 10. In a variant that is not illustrated, the spacing $S_c$ is variable for one and the same axial position along the longitudinal axis of the core and/or from one axial position to another. This spacing $S_c$ is for example between 0.3 mm and 2 mm, better still between 0.5 mm and 1 mm.

As shown in FIG. 4, the axial offset $D_a$ between one longitudinal row 17 of islets 15, 16 and the adjacent longitudinal row 20 is advantageously less than the length $L_g$ of an islet 15 of spikes in said adjacent row 20.

As shown notably in FIGS. 2 and 4, every other longitudinal row of islets has an isolated spike 28 at the proximal end 12 of the core 10.

As can be seen in FIG. 3, the implantation of the spikes 18 within the islets 15, 16 of spikes may be such that the angle $\alpha$ about the longitudinal axis X of the core 10 between two successive spikes 18 in the longitudinal direction L is non-zero, preferably being equal to half the angular pitch $\beta$ between two successive spikes 18 in the circumferential direction C.

In the variant in FIG. 5, the core 10 has, in the areas 14 free of spikes, a surface that is concave towards its longitudinal axis X, these regions being slightly recessed in the direction of the longitudinal axis X, for example to a depth $p_z$, measured perpendicularly to the longitudinal axis X, of between 0.01 mm and 0.05 mm.

In the examples in question, within one longitudinal row 17, 19, 20 of islets, the height of the spikes 18 increases from the proximal end 11 of the core, passing through a maximum, before decreasing in the direction of the distal end 12 of the core 10, the maximum height $H_m$ being situated halfway along the length H of the core 10, as can be seen in FIG. 2. In this case, all of the spikes 18 are the same height in the circumferential direction C, in each position on the longitudinal axis X of the core 10.

In a variant that is not illustrated, the spikes 18 are the same height within each islet 15, 16 of spikes.

The height $h_p$ of the spikes 18 is for example between 2 mm and 3 mm.

The width $l_p$ of the spikes 18 is for example between 0.3 mm and 0.65 mm.

The thickness $e_p$ of the spikes 18 is for example between 0.4 mm and 0.75 mm.

The spikes 18 may have various shapes, optionally varying within an islet 15, 16 and/or from one islet to another. In the examples in question, and as can be seen notably in FIG.

4, all the spikes 18 have a hexagonal base. The invention is not limited to one particular type of spikes, however.

In the examples in question, the free ends 28 of the spikes 18 define an envelope surface S of the applicator member 8, having a rectilinear longitudinal axis that is coincident with the longitudinal axis X of the core 10, and is rotationally symmetrical about said axis X.

The diameter $\varphi_1$ of the cross section of the envelope surface S passing through the tops of the spikes 18 of smallest height, visible in FIG. 3, is for example between 4 mm and 9 mm. The diameter $\varphi_2$ of the cross section of the envelope surface S passing through the tops of the spikes 18 of greatest height is for example between 5 mm and 10 mm.

The spikes 18 are made, in the examples in question, in one piece with the core 10 by moulding thermoplastic material.

In order to mould the applicator member 8, use can be made of any thermoplastic material which is or is not relatively rigid, for example SEBS, a silicone, latex, a material having improved slip, butyl, EPDM, a nitrile, a thermoplastic elastomer, a polyester elastomer, a polyamide elastomer, a polyethylene elastomer or a vinyl elastomer, a polyolefin such as PE or PP, PVC, EVA, PS, SEBS, SIS, PET, POM, PU, SAM, PA or PMMA. It is also possible to use a ceramic, for example based on alumina, a resin, for example of the urea-formaldehyde type, and possibly a material containing graphite as filler. It is possible notably to use the materials known under the trade names Teflon®, Hytrel®, Cariflex®, Alixine®, Santoprene®, Pebax® and Pollobas®, this list not being limiting.

In order to use the device 1, the user unscrews the closure cap 5 and withdraws the applicator member 8 from the container 3.

After the applicator member 8 has passed through the wiping member 6, a certain amount of product P remains in the areas 14 free of spikes created between the islets 15, 16 of spikes 18, creating reservoirs of product P along the entire length of the core 10 and on all sides, such that the eyelashes and/or eyebrows can be loaded satisfactorily with product P. Moreover, the eyelashes and/or eyebrows are separated satisfactorily, avoiding the formation of clumps, by virtue of the axial offset between the longitudinal rows 17, 19, 20 of islets of spikes 18.

Of course, the invention is not limited to the exemplary embodiments that have just been described.

At least one of the core 10 and a spike 18 may be flocked or undergo any heat treatment or mechanical treatment.

The expression "having a" should be understood as being synonymous with "comprising at least one", and "between" is understood as including the limits, unless specified to the contrary.

The invention claimed is:

1. An applicator for applying a cosmetic, makeup or care, product to the eyelashes and/or eyebrows, having an applicator member comprising:

a core that extends along a longitudinal axis, and, carried by the core, longitudinal rows of islets of spikes that are separated by areas free of spikes, wherein, in said applicator, each islets of spikes comprise a series of spikes in the longitudinal direction and a series of spikes in the circumferential direction, and each longitudinal row of islets of spikes is offset axially with respect to the adjacent longitudinal row such that the centre of each islet of spikes of the core is situated halfway along the length of an area free of spikes between two islets of spikes in the adjacent rows.

2. The applicator according to claim 1, wherein the spacing between the spikes of one islet, within the series of spikes in the longitudinal direction and circumferential direction, is the same for each islet, notably being more than ten times less than the spacing between two consecutive islets of spikes within a longitudinal row of islets.

3. The applicator according to claim 1, wherein at least one islet of spikes comprise a number of spikes in the circumferential direction that increases in the longitudinal direction from the proximal end of the core, passing through a maximum, before decreasing in the direction of the distal end of the core, the maximum of the number of spikes being situated notably at the centre of the islet.

4. The applicator according to claim 3, wherein all the islets of spikes comprise a number of spikes in the circumferential direction that increases in the longitudinal direction from the proximal end of the core, passing through a maximum, before decreasing in the direction of the distal end of the core, the maximum of the number of spikes being situated notably at the centre of the islet.

5. The applicator according to claim 1, wherein all the spikes at the periphery of an islet define a diamond-shaped external contour.

6. The applicator according to claim 1, wherein the islets of spikes of the same rank of one longitudinal row of islets out of two occupy the same axial position along the longitudinal axis of the core.

7. The applicator according to claim 1, wherein the spacing between the consecutive islets of spikes is constant within at least one longitudinal row of spikes.

8. The Applicator according to claim 7, wherein the spacing between the consecutive islets of spikes is constant within each longitudinal row.

9. The applicator according to claim 1, wherein the areas free of spikes form at least one helical strip that does not have spikes, extends through more than half a revolution about the longitudinal axis of the core and is delimited by the islets of spikes, the areas free of spikes notably forming at least two intersecting helical strips that do not have spikes and are delimited by the islets of spikes.

10. The applicator according to claim 1, wherein the implantation of spikes within the islets of spikes is such that the angular offset about the longitudinal axis of the core between two successive spikes in the longitudinal direction is non-zero.

11. The applicator according to claim 1, wherein the longitudinal rows of spikes are offset axially such that, starting from the proximal end of the core in the direction of its distal end, the last spike of an islet of spikes in one longitudinal row of islets occupies the same axial position as the first spike of an islet in the adjacent row.

12. The applicator according to claim 1, wherein the longitudinal rows of islets are offset axially such that, in the circumferential direction, the last spike of an islet of spikes in one longitudinal row of islets occupies the same longitudinal position as the first spike of an islet in the adjacent row.

13. The applicator according to claim 1, wherein the axial offset between one longitudinal row of islets of spikes and the adjacent longitudinal row is less than or equal to the length of an islet of spikes in said adjacent row.

14. The applicator according to claim 1, wherein all the islets of spikes have the same number of spikes.

15. The applicator according to claim 1, wherein the spikes of at least one islet are the same shape.

16. The Applicator according to claim 15, wherein all the spikes in a longitudinal row are the same shape.

17. The Applicator according to claim 16, wherein all the spikes of the applicator member are the same shape.

18. The applicator according to claim 1, wherein at least one longitudinal row of islets has an isolated spike at the distal end of the core.

19. The Applicator according to claim 18, wherein every other longitudinal row of islets has an isolated spike at the distal end of the core.

20. The applicator according to claim 1, wherein, within one longitudinal row of islets, the height of the spikes increases from the proximal end of the core, passing through a maximum, before decreasing in the direction of the distal end of the core.

21. The applicator according to claim 1, wherein all the spikes are the same height in the circumferential direction, in each position on the longitudinal axis of the core.

22. The applicator according to claim 1, wherein the spikes are moulded together with the core, notably from the same material.

23. A device for packaging and applying a product to the eyelashes and/or eyebrows, having an applicator according to claim 1 and a container containing the product to be applied.

24. An applicator for applying a cosmetic, makeup or care, product to the eyelashes and/or eyebrows, having an applicator member comprising:

a core that extends along a longitudinal axis, and, carried by the core, longitudinal rows of islets of spikes that are separated by areas free of spikes, wherein, in said applicator, the islets of spikes comprise a series of spikes in the longitudinal direction and a series of spikes in the circumferential direction, each longitudinal row of islets of spikes is offset axially with respect to the adjacent longitudinal row such that the centre of each islet of spikes of the core is situated halfway along the length of an area free of spikes between two islets of spikes in the adjacent rows, and at least one islet of spikes comprises a number of spikes in the circumferential direction that increases in the longitudinal direction from the proximal end of the core, passing through a maximum, before decreasing in the direction of the distal end of the core, the maximum of the number of spikes being situated notably at the centre of the islet.

25. An applicator for applying a cosmetic, makeup or care, product to the eyelashes and/or eyebrows, having an applicator member comprising:

a core that extends along a longitudinal axis, and, carried by the core, longitudinal rows of islets of spikes that are separated by areas free of spikes, wherein, in said applicator, the islets of spikes comprise a series of spikes in the longitudinal direction and a series of spikes in the circumferential direction, each longitudinal row of islets of spikes is offset axially with respect to the adjacent longitudinal row such that the centre of each islet of spikes of the core is situated halfway along the length of an area free of spikes between two islets of spikes in the adjacent rows, and within one longitudinal row of islets, the height of the spikes increases from the proximal end of the core, passing through a maximum, before decreasing in the direction of the distal end of the core.

* * * * *